United States Patent [19]

Bellia

[11] 3,940,840

[45] Mar. 2, 1976

[54] TOOL FOR EXTRACTION OF A PREFORMED FITTING FROM A PERIPHERAL GROOVE

[75] Inventor: Eugene Sauveur Bellia, Saint-Tropez, France

[73] Assignee: Etat Francais, Paris, France

[22] Filed: Sept. 9, 1974

[21] Appl. No.: 504,240

[30] Foreign Application Priority Data

Sept. 26, 1973 France ..... 73.34438

[52] U.S. Cl. ..... 29/235; 29/270

[51] Int. Cl.[2] ..... B25B 27/14

[58] Field of Search ..... 29/218, 227, 235, 256, 29/257, 270, 278, 280, 283; 81/170, 173–175; 269/49, 139; 294/19 R, 34, 103 R

[56] References Cited

UNITED STATES PATENTS

| | | | |
|---|---|---|---|
| 575,592 | 1/1897 | Canfield | 81/170 |
| 906,801 | 12/1908 | Hickey | 294/34 |
| 3,509,882 | 5/1970 | Blake | 29/227 |
| 3,577,848 | 5/1971 | Mengle | 29/235 |

*Primary Examiner*—Al Lawrence Smith
*Assistant Examiner*—Harold P. Smith, Jr.
*Attorney, Agent, or Firm*—Larson, Taylor and Hinds

[57] ABSTRACT

A tool is provided for the extraction of preformed fittings placed in a peripheral groove hollowed into the wall of a bore. A pincer device is formed by two tapered noses, one fixedly attached to a hollow body and the second attached to a piston capable of sliding within the hollow body. An adjustable stop controls the width of the pincer device, and a reference marking indicates the setting of the stop. A grip sleeve and positioning holder assist a user in operating the tool.

10 Claims, 4 Drawing Figures

TOOL FOR EXTRACTION OF A PREFORMED FITTING FROM A PERIPHERAL GROOVE

FIELD OF THE INVENTION

This invention relates to tools, and, more particularly, to a tool for extraction of a preformed fitting placed in a peripheral groove hollowed into the wall of a bore.

BACKGROUND OF THE INVENTION

Numerous mechanisms have preformed fittings to ensure tightness between a cylindrical rod and a bore in which the rod is disposed, the seal being static if the rod and the bore are stationary, or dynamic if the rod and the bore are driven in a relative movement.

The fitting can be mounted in a groove hollowed in the cylindrical rod or in a peripheral groove hollowed in the wall of the bore. In this case, if the fitting is circular, the mounting of the fitting is called "cylindrical."

Extraction of such a preformed fitting without deterioration of it is a problem that has been poorly managed so far. It is generally done with use of non specific tools such as pliers, spatulas or hooks, the use of which runs the risk of damaging the fitting to the point that it is no longer usable. Use of these tools also risks scoring the inner wall of the bore.

Tools used presently for extraction of fittings are poorly adapted to the situation in which the bore is very small, on the order of a centimeter, and to conditions in which the groove that contains the fitting is not very accessible because it is relatively remote from the end. In addition, these tools require manual manipulation near the end of the bore, and in certain cases, this is not possible because of environmental conditions, e.g. temperature, pressure, corrosive atmosphere, dangerous radiation.

An object of the present invention is to provide a specific tool for the extraction of preformed fittings from a peripheral groove without risk of damaging them or scoring the inner wall of the cavity in which the groove is hollowed.

Another object of the present invention is to provide a tool for the extraction of fittings that allows operation at some distance from the end of the bore, when environmental conditions do not allow access to said end.

A further object of the invention is to provide a tool for the extraction of preformed fittings from a peripheral groove hollowed in the wall of a cavity, even when accessibility of the groove is made difficult by the diameter or the length of the cavity.

Still another object of the invention is to provide a tool capable of a rapid rate of operation, which can be automated in the case of numerous repetitive operations.

BRIEF SUMMARY OF THE INVENTION

These objectives are attained by means of a tool comprising a cylindrical hollow body whose external diameter is less than the diameter of the said bore, at least one longitudinal slit, opening at one of the ends, at least one nose at the bottom of the slit projecting to the outside of the hollow body and a piston that slides inside the hollow body and presents at one of its ends at least one nose that engages in one of the slits of the hollow body and projects to the outside thereof.

This tool is partly engaged in the bore, in such a way that the noses penetrate into the groove containing a preformed fitting, on either side of it, and by causing the piston to slide in the cylindrical body, the noses are brought toward each other, thus gripping the fitting, which can be extracted from the groove.

The hollow cylindrical body has a peripheral sleeve that serves as a grip, located at the end that remains outside the bore. The tool also has a positioning holder in which the hollow body slides, presenting at one end, a plate for bearing against the bore opening, and the hollow body abuts against this holder. For example, the grip has a peripheral shoulder that bears on the end of the holder opposite the bearing plate. The grip extends beyond the rear end of the hollow body, and presents a central bore obturated by a threaded plug through which the piston passes, sliding freely. In this central bore there is a spring, around the piston, which bears, at one end, on a peripheral shoulder of said piston and, at the other end, on the threaded plug. This spring maintains the separation between the noses. The rear end of the piston, outside the threaded plug, has an adjustable stop that limits the travel of a threaded nut and allows adjustment of the initial separation of the noses, so that it corresponds to the width of the groove that contains the fitting.

The advantages of this tool are as follows:

It allows extraction of preformed fittings at a distance from the bore opening, or in bores with small diameter. In fact, it is possible to make tools of this type that can penetrate into bores with diameter of the order of a centimeter.

In case of a preformed fitting with non circular cross-section, e.g. cruciform section, this tool allows extraction of the fitting without damage to it. The force of the gripping on the fitting between the noses is precisely adjusted by loosening the threaded plug.

Interchangeable positioning holders allow automatic positioning of the tool to gain access to grooves located at different depths, which speeds up rates of operation in situations where operation is repetitive.

The tool according to the invention allows work at a distance from the bore that contains a fitting to be extracted, and hence management of environmental constraints.

DETAILED DESCRIPTION

Other features and advantages of the invention will be set forth in or apparent from a detailed description of a preferred embodiment found hereinbelow.

Figure 1:
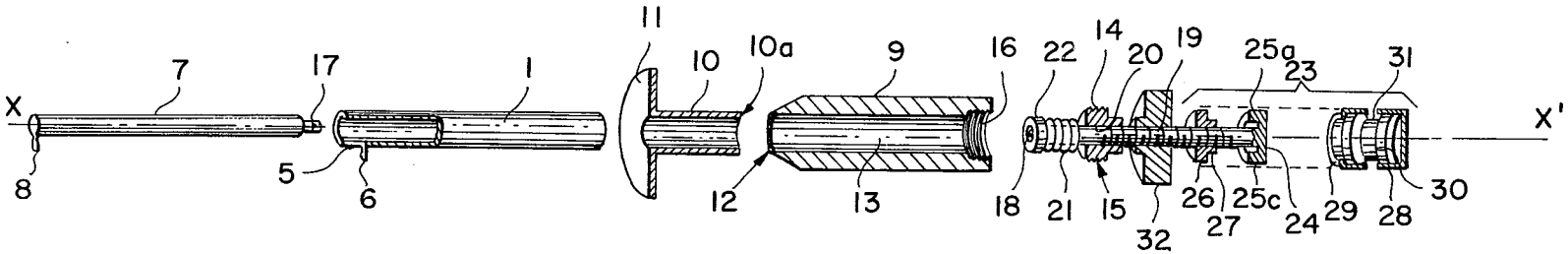
FIG. 1 is an exploded view, in perspective, with partial cutaways, of a tool according to the invention.
Figure 2:
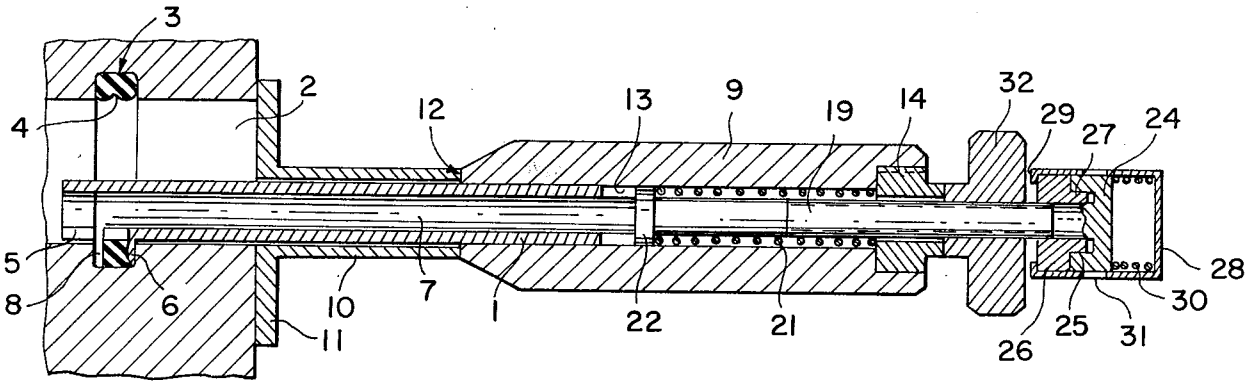
FIG. 2 is a longitudinal section of the same tool in operating position in a bore.

FIGS. 1 and 2 represent a tool comprising a hollow cylindrical body 1, whose external diameter is less than the internal diameter of a bore 2, comprising a peripheral groove 3 in which there is placed a preformed packing fitting 4. In the case of FIG. 2, there is shown by way of illustration a fitting that has a cruciform transverse section. Of course, this section could also be circular, or present any other configuration that is conventional for preformed fittings.

Figure 4:
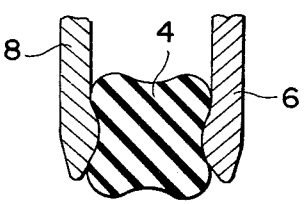
FIG. 4 is a section of the noses, on a larger scale.

At the front end which is engaged in the bore, cylinder 1 has a slit 5 opening at the end. At the bottom of this slit, there is a nose 6 projecting to the outside of the cylinder. This nose is tapered at its end. FIG. 2 shows nose 6 engaged in groove 3, between a flank thereof and fitting 4. The side of the nose that is turned toward the fitting preferably presents a form that is adapted to the transverse section of the fitting, as shown in FIG. 4.

A piston 7 is disposed in cylinder 1, its external diameter being substantially equal to the internal diameter of said cylinder, in which it can slide. Piston 7 has a tapered nose 8 at its end, engaging in slit 5. This nose prevents the rotation of the piston, with reference to the cylinder.

FIG. 2 shows nose 8 engaged in groove 3, between fitting 4 and the other flank of the groove. The two noses 6 and 8 constitute a pincer that grasps the fitting. The gripping of the fitting between the noses is effected by the sliding of piston 7 in cylinder 1.

Cylinder 1 has, at the back, a peripheral sleeve 9, rigidly connected to the cylinder, which serves as a grip. A positioning holder 10 is placed around cylinder 1, which can slide freely therein. This holder has a bearing plate 11 at its front end, applied about the mouth of bore 2. The front end of grip 9 forms a shoulder 12 that comes to abut against end 10*a* of positioning holder 10 opposite bearing plate 11. Holder 10 can be exchanged for other holders, of different length. The length of the holder is so selected that when grip 9 abuts on the holder, nose 6 is at a distance from the bore opening that corresponds to the separation between the right flank of groove 3 and this opening.

Grip 9 has a central bore 13 into which cylindrical body 1 engages. The rear end of bore 13 is obturated by a plug 14 which presents at its periphery a male threading 15 that is screwed into threaded bore 16 of grip 9. A threaded bore 18 borne by rod 19 which receives threaded end 17 of piston 7 and extends piston 7 to the back of the device. Rod 19 passes through threaded plug 14 in a central bore 20 in which it slides freely. It is threaded in its rear portion.

A spring 21 is seated in bore 13. It bears at the back on threaded plug 14 and at the front on a peripheral shoulder 22 of rod 19, which shoulder surrounds bore 18. The spring thrusts piston 7 forward and maintains a separation between noses 6 and 8. The device further comprises a nut 32 that is threaded onto rod 19. Rod 19 has an adjustable stop at its rear end, designated as a whole by reference number 23. This stop comprises a first fixed ring 24 constituting the head of rod 19, which presents a series of notches 25, of different depths.

For example, head 24 has two series of three notches 25*a*, 25*b*, 25*c*. The adjustable stop has a second movable ring 26 that slides on rod 19, and has two spurs in relief, 27, diametrically opposed, engaged in two of the notches 25.

Movable ring 26 is engaged in a peripheral cup 28 that presents a flange 29. A spring 30 bears on fixed ring 24 and on cup 28 and holds ring 26 applied against ring 24.

However, with compression of the spring, it is possible to release spurs 27 from notches 25 and to pivot ring 26, to engage spurs 27 in other notches 25, of different depth.

When nut 32 is unscrewed, it abuts against ring 26, allowing adjustment of the position of nut 32, the separation of noses 6 and 8, and the tightening of the fitting in the pincer formed by the two noses.

Figure 3:
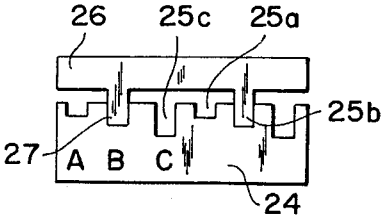
FIG. 3 is an explanatory diagram of the adjustable stop in FIGS. 1 and 2.

FIG. 3 is an explanatory diagram of rings 24 and 26 on which notches 25*a*, 25*b* and 25*c*, of different depths, are clearly seen, presented by fixed ring 24, and the two spurs 27 presented by the movable ring. In this figure, spurs 27 are shown engaged in notches 25*b*.

References, e.g. A, B, C are marked on fixed ring 24 opposite notches 25. Cup 28 has a window 31, aligned with one of spurs 27. Cup 28 turns at the same time as the movable ring and the reference shows up in window 31 that corresponds to the setting of the movable stop.

The operation of a tool according to the invention is as follows.

By turning ring 26, the separation of the noses is selected, adapted to the width of groove 3, which is known, and read in window 31. The tool is equipped with a positioning holder 10 corresponding to the position of groove 3 with reference to the mouth of the bore 2. The tool is introduced into the bore. It is moved toward the periphery of the bore so that noses 6 and 8 engage in groove 3 on either side of fitting 4. Nut 32 is unscrewed until it comes to bear on ring 26.

Spring 21 thrusts rod 19 forward until nut 32 abuts against plug 14. This position corresponds to the maximum separation of the noses, which is equal to the width of groove 3.

Once the noses are engaged in the groove, nut 32 is gradually screwed, which has the effect of bringing threaded rod 19 toward the back, compressing spring 21 and tightening noses 6 and 8 on the fitting. Once the pincer has been formed by the noses and is sufficiently tightened, the tool is removed from the periphery of the bore, which effects extraction of the fitting from the groove.

Although the invention has been described with respect to an exemplary embodiment thereof, it will be understood that variations and modifications can be effected in the embodiment without departing from the scope or spirit of the invention.

What is claimed is:

1. A tool for extracting a preformed fitting from a peripheral groove hollowed in the wall of a bore comprising:

a cylindrical, hollow body having an external diameter less than the diameter of said bore, at least one longitudinal slit opening at one of the ends of said hollow body and at least one nose, disposed at the bottom of said slit and projecting to the outside of said hollow body;

a piston capable of sliding inside said hollow body, having at least one nose at one of the ends of said piston, positioned so as to engage in said at least one slit of said hollow body, and projecting to the outside thereof;

said tool including means for positioning said one end of said hollow body within a bore to position the nose of said hollow body and the nose of said piston at a pre-determined position within said bore.

2. A tool as claimed in claim 1 further comprising a peripheral sleeve surrounding said hollow body and disposed at the end thereof remote from said one end that remains outside said bore, so as to serve as a grip.

3. A tool as claimed in claim 1 further comprising a positioning holder, in which said hollow body slides, having at one end a bearing plate to be applied about the opening of said bore.

4. A tool as claimed in claim 3 wherein said hollow body has a peripheral sleeve which serves as a grip disposed at the end thereof that remains outside said bore, said sleeve having a peripheral shoulder that bears on the end of said positioning holder opposite said bearing plate.

5. A tool as claimed in claim 4 wherein said sleeve extends beyond the rear end of said hollow body and presents a central bore, said bore being obturated by a threaded plug through which said piston freely passes.

6. A tool as claimed in claim 5 further comprising a spring disposed about said piston inside said central bore of said sleeve, said spring bearing on a peripheral shoulder of said piston at one end, and bearing on said threaded plug at the other end so as to maintain the separation between said nose of said hollow body and said nose of said piston.

7. A tool as claimed in claim 5 wherein said piston is extended by a threaded rod, and further comprises a nut screwed on said threaded rod, and an adjustable stop against which said nut bears when unscrewed.

8. A tool as claimed in claim 7 wherein said adjustable stop comprises a first ring constituting a head to said piston, said first ring presenting a series of notches of different depths, and a second ring, which slides about said piston, having at least one spur, in relief, on the face of said second ring turned toward said first ring, so that said at least one spur engages in one of the said notches, depending on the relative positions of said first and second rings.

9. A tool as claimed in claim 8 wherein said second ring is held against said first ring by a peripheral cup, said cup cooperating with a spring that bears on said first ring, at one end, and the bottom of said cup at the other end.

10. A tool as claimed in claim 9 wherein said cup has a window through which appears a reference marked on said first ring opposite each of said notches, so that said reference corresponds to the position of said adjustable stop, thus indicating the width of a groove containing a fitting to be extracted.

* * * * *